US006105369A

United States Patent [19]

Peletz, Jr.

[11] Patent Number: 6,105,369

[45] Date of Patent: Aug. 22, 2000

[54] HYBRID DUAL CYCLE VAPOR GENERATION

[75] Inventor: Lawrence J. Peletz, Jr., Erie, Pa.

[73] Assignee: ABB Alstom Power Inc., Windsor, Conn.

[21] Appl. No.: 09/229,367

[22] Filed: Jan. 13, 1999

[51] Int. Cl.[7] ..... F01K 25/06

[52] U.S. Cl. ..... 60/649; 60/671; 60/679

[58] Field of Search ..... 60/649, 671, 677, 60/679

[56] References Cited

U.S. PATENT DOCUMENTS

| | | | |
|---|---|---|---|
| 2,830,440 | 4/1958 | Durham | 60/677 X |
| 2,984,984 | 5/1961 | Dickey | 60/679 X |
| 3,105,357 | 10/1963 | Vogler | 60/679 X |
| 3,234,734 | 2/1966 | Buss et al. | 60/677 X |
| 4,489,563 | 12/1984 | Kalina | 60/673 |
| 4,732,005 | 3/1988 | Kalina | 60/673 |
| 4,838,027 | 6/1989 | Rosado et al. | 60/671 |
| 4,982,568 | 1/1991 | Kalina | 60/671 X |
| 5,029,444 | 7/1991 | Kalina | 60/673 |
| 5,095,708 | 3/1992 | Kalina | 60/673 |
| 5,440,882 | 8/1995 | Kalina | 60/641.2 |
| 5,450,821 | 9/1995 | Kalina | 122/1 |
| 5,570,578 | 11/1996 | Saujet et al. | 60/677 X |
| 5,572,871 | 11/1996 | Kalina | 60/649 |
| 5,588,298 | 12/1996 | Kalina et al. | 60/673 |

OTHER PUBLICATIONS

Kalina Cycles for Efficient Direct Fired Application,—Alexander I. Kalina, Yakov Lerner, Richard I. Pelletier, Exergy, Inc., Lawrence J. Peletz, Jr. ABB CE systems, Combustion engineering, Inc., –7 pgs. (No Date).

Kalina Cycle Looks Good for Combined Cycle Generation—Dr. James C. Corman, Dr. Robert W. Bjorge, GE Power Systems, Dr. Alexander Kalina, Exergy, Inc., Jul. 1995–3 pgs.

Power Perspective, The Kalina Cycle—More Electricity From Each BTU of Fuel—1995–3 pgs. (No Date).

A Gas Turbine–Aqua Ammonia Combined Power Cycle–Irby Hicks, The Thermosorb Company—Mar. 25, 1996–6 pgs.

Understanding the Kalina Cycle Fundamentals—H.A. Micak, P.E., ABB Lummus Crest–12 pgs. (No Date).

Direct–Fired Kalina Cycle: Overview–ABB–1994–13 pgs.

Kalina Cycle System Advancements for Direct Fired Power Generation, Michael J. Davidson, Lawrence J. Peletz, ABB Combustion Engineering,–9 pgs. (No Date).

Kalina Cycles and System for Direct–Fired Power Plants, A.I. Kalina, Exergy, Inc., AES–vol. 25/HTD–vol. 191–7 pgs. (No Date).

*Primary Examiner*—Hoang Nguyen
*Attorney, Agent, or Firm*—Lalos & Keegan

[57] ABSTRACT

A vapor generator includes a first plurality of tubes configured to direct a multicomponent working fluid so as to be subjected to process heat from a direct fired source, and a second plurality of tubes configured to direct a single component working fluid so as to be subjected to the process heat. The first plurality of tubes form a furnace wall with the multicomponent working fluid being supplied to the furnace wall in a vapor state. The multicomponent working fluid absorbs a portion of the process heat from the furnace wall thereby cooling the furnace wall. A backpass receives flue gases, and the second plurality of tubes are located in the backpass to absorb heat from the flue gases of the backpass so that the single component working fluid increases in temperature and the flue gases are cooled.

25 Claims, 7 Drawing Sheets

HYBRID DUAL CYCLE VAPOR GENERATION

CROSS-REFERENCE TO RELATED APPLICATIONS

The present application relates to pending U.S. patent application Ser. No. 09/231,165, filed Jan. 12, 1999, for "TECHNIQUE FOR CONTROLLING REGENERATIVE SYSTEM CONDENSATION LEVEL DUE TO CHANGING CONDITIONS IN A KALINA CYCLE POWER GENERATION SYSTEM"; U.S. patent application Ser. No. 09/231,171, filed Jan. 12, 1999, for "TECHNIQUE FOR BALANCING REGENERATIVE REQUIREMENTS DUE TO PRESSURE CHANGES IN A KALINA CYCLE POWER GENERATION SYSTEM"; U.S. patent application Ser. No. 09/229,364, filed Jan. 12,1999, for "TECHNIQUE FOR CONTROLLING SUPERHEATED VAPOR REQUIREMENTS DUE TO VARYING CONDITIONS IN A KALINA CYCLE POWER GENERATION SYSTEM"; U.S. patent application Ser. No. 09/231,166, filed Jan. 12, 1999, for "TECHNIQUE FOR MAINTAINING PROPER DRUM LIQUID LEVEL IN A KALINA CYCLE POWER GENERATION SYSTEM"; U.S. patent application Ser. No. 09/229,629, filed Jan. 12, 1999, for "TECHNIQUE FOR CONTROLLING DCSS CONDENSATE LEVELS IN A KALINA CYCLE POWER GENERATION SYSTEM"; U.S. patent application Ser. No. 09/229,630, filed Jan. 12, 1999, for "TECHNIQUE FOR MAINTAINING PROPER FLOW IN PARALLEL HEAT EXCHANGERS IN A KALINA CYCLE POWER GENERATION SYSTEM"; U.S. patent application Ser. No. 09/229,631, filed Jan. 12, 1999, for "TECHNIQUE FOR MAINTAINING PROPER VAPOR TEMPERATURE AT THE SUPER HEATER/REHEATER INLET IN A KALINA CYCLE POWER GENERATION SYSTEM"; U.S. patent application Ser. No. 09/231,164, filed Jan. 12, 1999, for "WASTE HEAT KALINA CYCLE POWER GENERATION SYSTEM"; U.S. patent application Ser. No. 09/229,366, filed Jan. 12, 1999, for "MATERIAL SELECTION AND CONDITIONING TO AVOID BRITTLENESS CAUSED BY NITRIDING"; U.S. patent application Ser. No. 09/231,168, filed Jan. 12, 1999, for "REFURBISHING CONVENTIONAL POWER PLANTS FOR KALINA CYCLE OPERATION"; U.S. patent application Ser. No. 09/231,170, filed Jan. 12, 1999, for "STARTUP TECHNIQUE USING MULTIMODE OPERATION IN A KALINA CYCLE POWER GENERATION SYSTEM"; U.S. patent application Ser. No. 09/231,163, filed Jan. 12, 1999, for "TECHNIQUE FOR COOLING FURNACE WALLS IN A MULTICOMPONENT WORKING FLUID POWER GENERATION SYSTEM"; U.S. patent application Ser. No. 09/229,632, filed Jan. 13, 1999, for "BLOWDOWN RECOVERY SYSTEM IN A KALINA CYCLE POWER GENERATION SYSTEM"; U.S. patent application Ser. No. 09/229,368, filed Jan. 12, 1999, for "REGENERATIVE SUBSYSTEM CONTROL IN A KALINA CYCLE POWER GENERATION SYSTEM"; U.S. patent application Ser. No. 09/229,363, filed Jan. 12, 1999, for "DISTILLATION AND CONDENSATION SUBSYSTEM (DCSS) CONTROL IN A KALINA CYCLE POWER GENERATION SYSTEM"; U.S. patent application Ser. No. 09/229,365, filed Jan. 12, 1999, for "VAPOR TEMPERATURE CONTROL IN A KALINA CYCLE POWER GENERATION SYSTEM"; U.S. patent application Ser. No. 09/231,169, filed Jan. 12, 1999, for "FLUIDIZED BED FOR KALINA CYCLE POWER GENERATION SYSTEM"; U.S. patent application Ser. No. 09/231,167, filed Jan. 12, 1999, for "TECHNIQUE FOR RECOVERING WASTE HEAT USING A BINARY WORKING FLUID".

FIELD OF THE INVENTION

The present invention is in the field of power generation. In particular, the present invention is related to a vapor generation system used in the field of power generation.

BACKGROUND OF THE INVENTION

In recent years, industrial and utility concerns with deregulation and operational costs have strengthened demands for increased power plant efficiency. The Rankine cycle power plant, which typically utilizes water as the working fluid, has been the mainstay for the utility and industrial power industry for the last 150 years. In a Rankine cycle power plant, heat energy is converted into electrical energy by heating a working fluid flowing through tubular walls, commonly referred to as waterwalls, to form a vapor, e.g., turning water into steam. Typically, the vapor will be superheated to form a high pressure vapor, e.g., superheated steam. The high pressure vapor is used to power a turbine/generator to generate electricity.

Conventional Rankine cycle power generation systems can be of various types, including direct-fired, fluidized bed and waste-heat type systems. In direct fired and fluidized bed type systems, combustion process heat is generated by burning fuel to heat the combustion air which in turn heats the working fluid circulating through the systems waterwalls. In direct-fired Rankine cycle power generation systems the fuel, commonly pulverized-coal, gas or oil, is ignited in burners located in the waterwalls. In bubbling fluidized bed Rankine cycle power generation systems pulverized-coal is ignited in a bed located at the base of the boiler to generate combustion process heat. Waste-heat Rankine cycle power generation systems rely on heat generated in another process, e.g., incineration, for process heat to vaporize, and if desired superheat, the working fluid. Due to the metallurgical limitations, the highest temperature of the superheated steam does not normally exceed 1050° F. (566° C.). However, in some "aggressive" designs, this temperature can be as high as 1100° F. (593° C.).

Over the years, efficiency gains in Rankine cycle power systems have been achieved through technological improvements which have allowed working fluid temperatures and pressures to increase and exhaust gas temperatures and pressures to decrease. An important factor in the efficiency of the heat transfer is the average temperature of the working fluid during the transfer of heat from the heat source. If the temperature of the working fluid is significantly lower than the temperature of the available heat source the efficiency of the cycle will be significantly reduced. This effect, to some extent, explains the difficulty in achieving further gains in efficiency in conventional, Rankine cycle-based, power plants.

In view of the above, a departure from the Rankine cycle has recently been proposed. The proposed new cycle, commonly referred to as the Kalina cycle, attempts to exploit the additional degree of freedom available when using a binary fluid, more particularly an ammonia/water mixture, as the working fluid. The Kalina cycle is described in the paper entitled: "Kalina Cycle System Advancements for Direct Fired Power Generation", co-authored by Michael J. Davidson and Lawrence J. Peletz, Jr., and published by Combustion Engineering, Inc., of Windsor, Conn. Efficiency gains are obtained in the Kalina cycle plant by reducing the energy losses during the conversion of heat energy into electrical output.

A simplified conventional direct-fired Kalina cycle power generation system is illustrated in FIG. 1 of the drawings. Kalina cycle power plants are characterized by three basic system elements, the Distillation and Condensation Subsystem (DCSS) 100, the Vapor Subsystem (VSS) 110 which includes the boiler 142, superheater 144 and recuperative heat exchanger (RHE) 140, and the turbine/generator subsystem (TGSS) 130. The DCSS 100 and RHE 140 are sometimes jointly referred to as the Regenerative Subsystem (RSS) 150. The boiler 142 is formed of tubular walls 142*a* and the superheater 144 is formed of tubular walls and/or banks of fluid tubes 144*a*. A heat source 120 provides process heat 121. A portion 123 of the process heat 121 is used to vaporize the working fluid in the boiler 142. Another portion 122 of the process heat 121 is used to superheat the vaporized working fluid in the superheater 144.

During normal operation of the Kalina cycle power system of FIG. 1, the ammonia/water working fluid is fed to the boiler 142 from the RHE 140 by liquid stream FS 5 and from the DCSS 100 by liquid stream FS 7. The working fluid is vaporized, i.e., boiled, in the tubular walls 142*a* of the boiler 142. The FS rich working fluid stream 20 from the DCSS 100 is also vaporized in the heat exchanger(s) of the RHE 140.

In one implementation, the vaporized working fluid from the boiler 142 along with the vaporized working fluid FS 9 from the RHE 140, is further heated in the tubular walls/fluid tube bank 144*a* of the superheater 144. The superheated vapor from the superheater 144 is directed to and powers the TGSS 130 as FS vapor 40 so that electrical power 131 is generated to meet the load requirement. In an alternative implementation, the RHE 140 not only vaporizes but also superheats the rich stream FS 20. In such a case, the superheated vapor flow FS 9' from the RHE 140 is combined with the superheated vapor from the superheater 144 to form FS vapor flow 40 to the TGSS 130.

Expanded working fluid FS extraction 11 egresses from the TGSS 130, e.g., from a low pressure (LP) turbine (not shown) within the TGSS 130, and is directed to the DCSS 100. This expanded working fluid is, in part, condensed in the DCSS 100. Working fluid condensed in the DCSS 100, as described above, forms feed fluid FS 7 which is fed to the boiler 142. Another key feature of the DCSS 100 is the separation of the working fluid egressing from TGSS 130 into ammonia rich and ammonia lean streams for use by the VSS 110. In this regard, the DCSS 100 separates the expanded working fluid into an ammonia rich working fluid flow FS rich 20 and an ammonia lean working fluid flow FS lean 30. Waste heat 101 from the DCSS 100 is dumped to a heat sink, such as a river or pond.

The rich and lean flows FS 20, FS 30, respectively, are fed to the RHE 140. Another somewhat less expanded hot working fluid FS extraction 10 egresses from the TGSS 130, e.g., from a high pressure (HP) turbine (not shown) within the TGSS 130, and is directed to the RHE 140. Heat is transferred from the expanded working fluid FS extraction 10 and the working fluid FS lean stream 30 to the rich working fluid flow FS rich 20, to thereby vaporize the rich flow FS 20 and condense, at least in part, the expanded working fluid FS extraction 10 and FS lean working fluid flow 30, in the RHE 140. As discussed above, the vaporized rich flow FS 20 is fed to either the superheater 144, along with vaporized feed fluid from the boiler 142, or is combined with the superheated working fluid from the superheater 142 and fed directly to the TGSS 130. The condensed expanded working fluid from the RHE 140 forms part of the feed flow, i.e., flow FS 5, to the boiler 142, as has been previously described.

FIG. 2 details a portion of the RHE 140 of VSS 110 of FIG. 1. As shown, the RHE 140 receives ammonia-rich, cold high pressure stream FS rich 20 from DCSS 100. Stream FS rich 20 is heated by ammonia-lean hot low pressure stream FS 3010. The stream FS 3010 is formed by combining the somewhat lean hot low pressure FS extraction stream 10 from TGSS 130 with the lean hot low pressure stream FS 30 from DCSS 100, these flows being combined such that stream FS 30 dilutes stream FS 10 resulting in a desired concentration of ammonia in stream FS 3010.

Heat energy 125, is transferred from stream FS 3010 to stream FS rich 20. As discussed above, this causes the transformation of stream FS 20 into a high pressure vapor stream FS 9 or the high pressure superheated vapor stream FS 9', depending on the pressure and concentration of the rich working fluid stream FS 20. This also causes the working fluid stream FS 3010 to be condensed and therefore serve as a liquid feed flow FS 5 to the boiler 142.

As previously indicated, in one implementation the vapor stream FS 9 along with the vapor output from boiler 142 forms the vapor input to the superheater 144, and the superheater 144 superheats the vapor stream to form superheated vapor stream 40 which is used to power TGSS 130. Alternatively, the superheated vapor steam FS 9' along with the superheated vapor output from the superheater 144 forms the superheated vapor stream FS 40 to the TGSS 130.

FIG. 3 illustrates exemplary heat transfer curves for heat exchanges occurring in the RHE 140 of FIG. 2. A typical Kalina cycle heat exchange is represented by curves 520 and 530. As shown, the temperature of the liquid binary working fluid FS 20 represented by curve 520 increases as a function of the distance of travel of the working fluid through the heat exchanger of the RHE 140 in a substantially linear manner. That is, the temperature of the working fluid continues to increase even during boiling as the working fluid travels through the heat exchanger of the RHE 140 shown in FIG. 2. At the same time, the temperature of the liquid working fluid FS 3010 represented by curve 530 decreases as a function of the distance of travel of this working fluid through the heat exchanger of the RHE 140 in a substantially linear manner. That is, as heat energy 125 is transferred from working fluid FS 3010 to the working fluid stream FS 20 as both fluid streams flow in opposed directions through the RHE 140 heat exchanger of FIG. 2, the binary working fluid FS 3010 loses heat and the binary working fluid stream FS 20 gains heat at substantially the same rate within the Kalina cycle heat exchangers of the RHE 140.

In contrast, a typical Rankine cycle heat exchange is represented by curve 510. As shown, the temperature of the water or water/steam mixture forming the working fluid represented by curve 510 increases as a function of the distance of travel of the working fluid through a heat exchanger of the type shown in FIG. 2 only after the working fluid has been fully evaporated, i.e., vaporized. The portion 511 of curve 510 represents the temperature of the water or water/steam mixture during boiling. As indicated, the temperature of the working fluid remains substantially constant until the boiling duty has been completed. That is, in a typical Rankine cycle, the temperature of the working fluid does not increase during boiling. Rather, as indicated by portion 512 of curve 510, it is only after full vaporization, i.e., full phase transformation, that the temperature of the working fluid in a typical Rankine cycle increases beyond the boiling point temperature of the working fluid, e.g., 212° F.

As will be noted, the temperature differential between the stream represented by curve 530, which transfers the heat energy, and the Rankine cycle stream represented by curve 510, which absorbs the heat energy, continues to increase during phase transformation. The differential becomes greatest just before complete vaporization of the working fluids. In contrast, the temperature differential between the stream represented by curve 530, and the Kalina cycle stream represented by curve 520, which absorbs the heat energy, remains relatively small, and substantially constant, during phase transformation. This further highlights the enhanced efficiency of Kalina cycle heat exchange in comparison to Rankine cycle heat exchange.

As indicated above, the transformation in the RHE 140 of the liquid or mixed liquid/vapor stream FS 20 to vapor or superheated vapor stream FS 9 or 9' is possible in the Kalina cycle because, the boiling point of rich cold high pressure stream FS 20 is substantially lower than that of lean hot low pressure stream FS 3010. This allows additional boiling, and in some implementations superheating, duty to be performed in the Kalina cycle RHE 140 and hence outside the boiler 142 and/or superheater 144. Hence, in the Kalina cycle, a greater portion of the process heat 121 can be used for superheating vaporized working fluid in the superheater 144, and less process heat 121 is required for boiling duty in the boiler 142. The net result is increased efficiency of the power generation system when compared to a conventional Rankine cycle type power generation system.

FIG. 4 further depicts the TGSS 130 of FIG. 1. As illustrated, the TGSS 130 in a Kalina cycle power generation system is driven by a high pressure superheated binary fluid vapor stream FS 40. Relatively lean hot low pressure stream FS extraction 10 is directed from, for instance the exhaust of an HP turbine (not shown) within the TGSS 130 to the RHE 140 as shown in FIGS. 1 and 2. A relatively lean cooler, even lower pressure flow FS extraction 11 is directed from, for instance, the exhaust of an LP turbine (not shown) within the TGSS 130 to the DCSS 100 as shown in FIG. 1. As has been discussed to some extent, both FS extraction flow 10 and FS extraction flow 11 retain enough heat to transfer energy to still cooler higher pressure streams in the DCSS 100 and RHE 140.

A vapor generator of a power generation system is subjected to intense heat energy, a portion of which is converted into vapor which drives turbines producing mechanical motion and ultimately electrical energy. Although there is an advantage to operating at high temperatures, a cooling system is still required that assures the temperature of sensitive components located in high temperature parts of the vapor generator will not exceed a value which may cause damage to those components.

In a vapor generation system, hot combustion gases are heating the tubes of the working fluid delivery subsystems. To protect these tubes from the danger of damage due to overheating, the tubes must be cooled, especially in the high temperature side of the furnace where the tubes are receiving direct radiant energy from the combustion gases.

In another aspect of the cooling system, the combustion gases, in addition to components of the furnace, may also have to be cooled. In particular, in the backpass of the furnace, the combustion gases must be cooled to a smokestack temperature. The combustion gases generated in the combustion chamber travel throughout the furnace by convection loosing heat to the various heating components, and ultimately are expelled into the atmosphere through a smoke stack. Before the gases are expelled into the atmosphere, they must be cooled to below a temperature denoted as the smokestack temperature.

OBJECTS OF THE INVENTION

Accordingly, it is an object of the present invention to incorporate a multicomponent stream and a single component stream into a vapor generator.

It is also an object of the present invention to incorporate two cooling streams, a multicomponent stream and a single component stream, into a vapor generator.

It is a further object of the present invention to increase heat transfer efficiency of a vapor generator by utilizing the heat in the backpass section of the vapor generator.

Additional objects, advantages, novel features of the present invention will become apparent to those skilled in the art from this disclosure, including the following detailed description, as well as by practice of the invention. While the invention is described below with reference to a preferred embodiment(s), it should be understood that the invention is not limited thereto. Those of ordinary skill in the art having access to the teachings herein will recognize additional implementations, modifications, and embodiments, as well as other fields of use, which are within the scope of the invention as disclosed and claimed herein and with respect to which the invention could be of significant utility.

SUMMARY OF THE INVENTION

According to the present invention, a vapor generator includes a first plurality of tubes configured to direct a multicomponent working fluid so as to be subjected to process heat, and a second plurality of tubes configured to direct a single component working fluid so as to be subjected to the process heat. The multicomponent working fluid may be any mixture of chemicals or compounds, and preferably is a mixture of ammonia and water. The single component working fluid is composed of a single compound, and preferably is water.

In a further aspect of the present invention, the first plurality of tubes form a furnace wall with the multicomponent working fluid being supplied to the furnace wall in a vapor state.

In still a further aspect of the present invention, the multicomponent working fluid absorbs a portion of the process heat from the furnace wall thereby cooling the furnace wall.

In yet another aspect of the present invention, the furnace all is located on a high temperature side of the furnace.

In another aspect of the present invention, the first plurality of tubes form a superheater.

In accordance with still another aspect of the present invention, the process heat is heat from a direct fired source.

In another aspect of the present invention, a backpass receives flue gases, and the second plurality of tubes are located in the backpass to absorb heat from the flue gases of the backpass so that the single component working fluid increases in temperature and the flue gases are cooled.

In a further aspect of the present invention, the second plurality of tubes are configured to vaporize the single component working fluid.

In still another aspect of the present invention, the second plurality of tubes are configured to superheat the single component working fluid.

In a further aspect of the present invention, the first plurality of tubes form a superheater.

In still another aspect of the present invention, the second plurality of tubes form a boiler.

In yet another aspect of the present invention, the multicomponent working fluid forms the working fluid of a non-Rankine cycle subsystem.

In a further aspect of the present invention, the multicomponent working fluid forms the working fluid of a Kalina cycle subsystem.

In a further aspect of the present invention, the single component working fluid forms the working fluid of a Rankine cycle subsystem.

According to the present invention, a system for generating power includes a heat source producing heat, and a vapor generator, including, a first plurality of tubes configured to direct a multicomponent working fluid so as to be subjected to the heat, and a second plurality of tubes configured to direct a single component working fluid so as to be subjected to the heat.

In a further aspect of the present invention, the vapor generator further includes the first plurality of tubes forming a furnace wall with the multicomponent working fluid being supplied to the furnace wall in a vapor state.

In still another aspect of the present invention, the vapor generator further includes a backpass receiving flue gases. The second plurality of tubes are located in the backpass to absorb heat from the flue gases of the backpass so that the single component working fluid increases in temperature and the flue gases are cooled.

In a further aspect of the present invention, a non-Rankine cycle turbine, coupled to the vapor generator, receives the multicomponent working fluid from the first plurality of tubes. A Rankine cycle turbine, also coupled to the vapor generator, receives the single component working fluid from the second plurality of tubes.

In yet another aspect of the present invention, the non-Rankine cycle turbine receives the multicomponent working fluid from one or more superheaters and the one or more superheaters receive the multicomponent working fluid from the first plurality of tubes.

In still another aspect of the present invention, the Rankine cycle turbine receives the single component working fluid from one or more superheaters and the one or more superheaters receive the single component working fluid from the second plurality of tubes.

According to the present invention, power is generated by moving a multicomponent working fluid through a first plurality of tubes so as to be subjected to process heat, and moving a single component working fluid through a second plurality of tubes so as to be subjected to the process heat.

In yet another aspect of the present invention, the first plurality of tubes form a furnace wall with the multicomponent working fluid being supplied to the furnace wall in a vapor state.

In a further aspect of the present invention, the multicomponent working fluid absorbs a portion of the process heat from the furnace wall thereby cooling the furnace wall.

In yet another aspect of the present invention, a backpass receives flue gases, and the second plurality of tubes are located in the backpass to absorb heat from the flue gases of the backpass so that the single component working fluid increases in temperature and the flue gases are cooled.

In still another aspect of the present invention, the multicomponent working fluid is moved through a non-Rankine cycle turbine to produce work, and the single component working fluid is moved through a Rankine cycle turbine to produce work.

BRIEF DESCRIPTION OF THE DRAWINGS

In order to facilitate a fuller understanding of the present invention, reference is now made to the appended drawings. These drawings should not be construed as limiting the present invention, but are intended to be exemplary only.

DETAILED DESCRIPTION OF THE INVENTION

Figure 1:
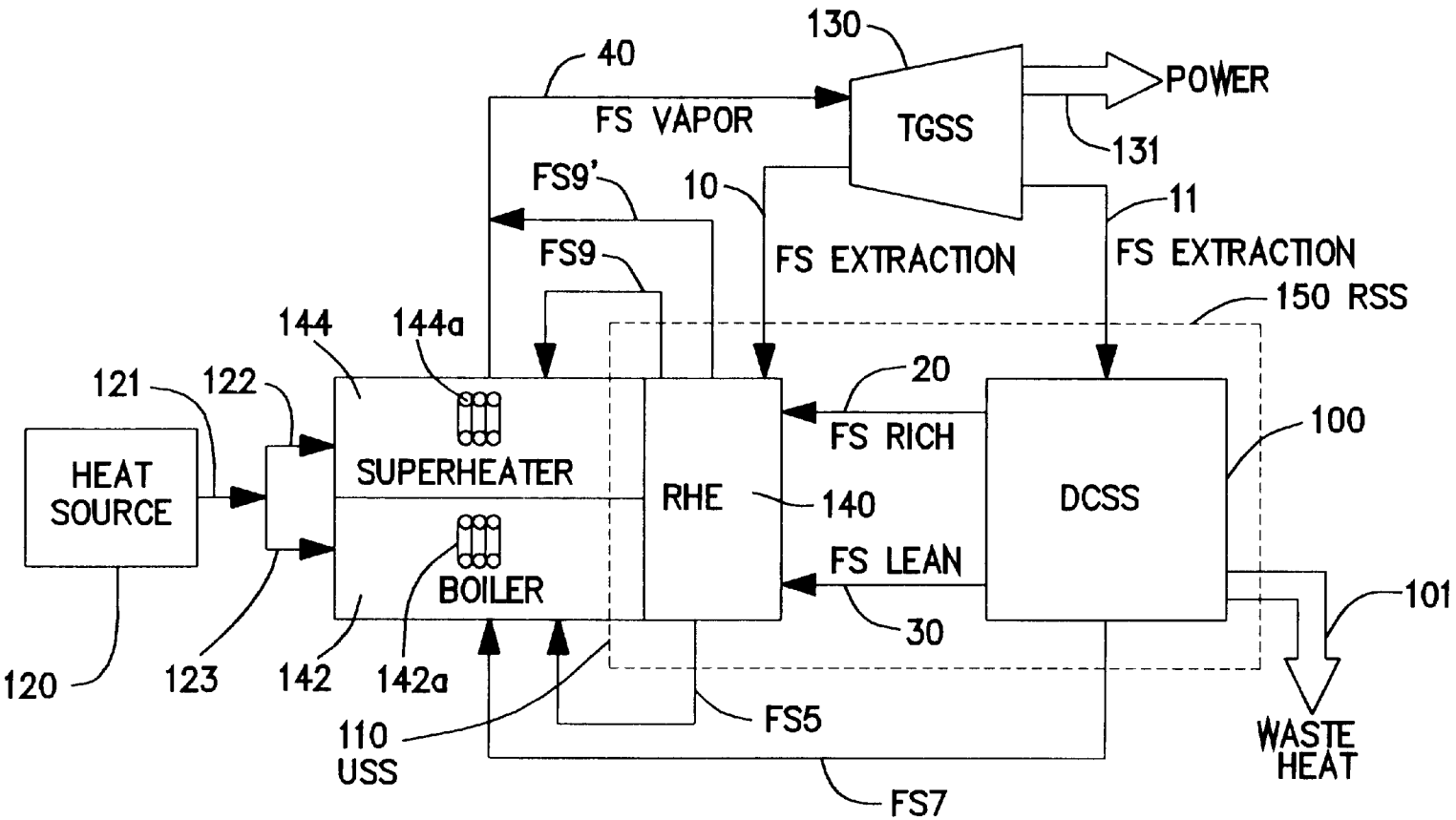
Figure 1 (PRIOR ART)
FIG. 1 is a simplified block diagram of a prior art Kalina cycle system.
Figure 2:
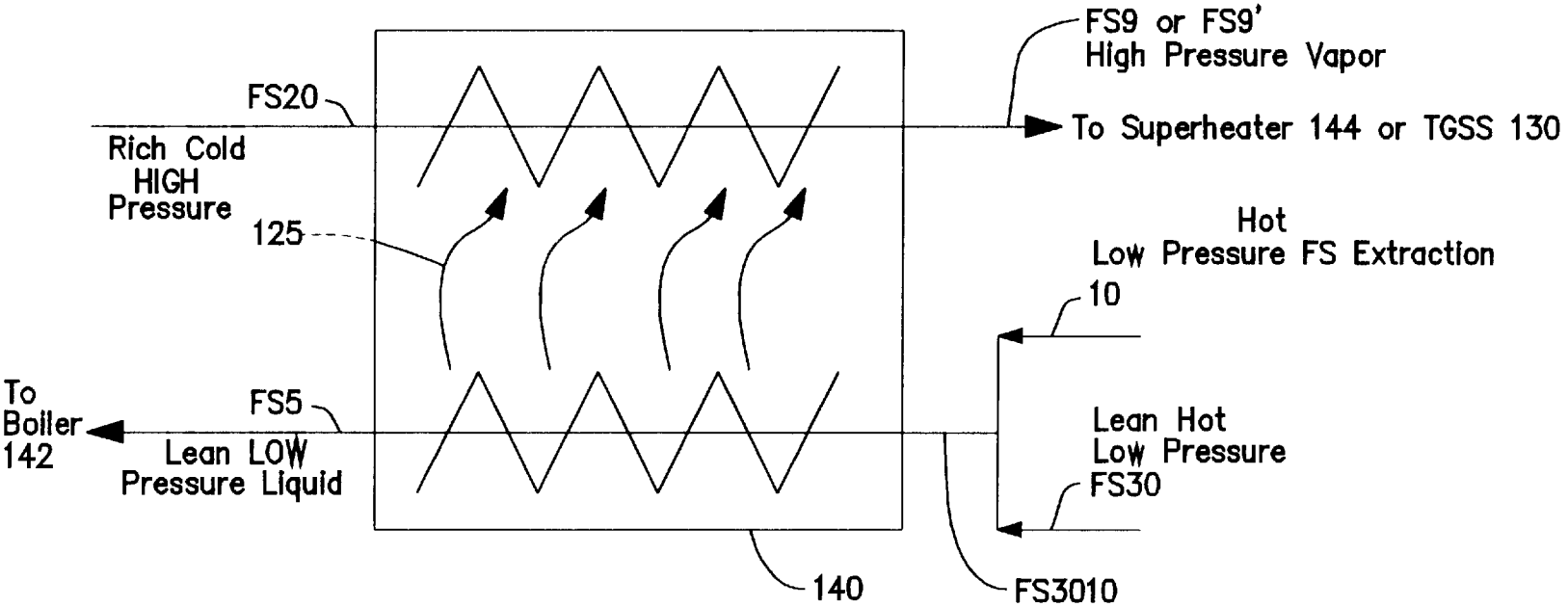
Figure 2 (PRIOR ART)
FIG. 2 is a diagram illustrating basic heat exchange between two flow streams in a conventional Kalina cycle system.
Figure 3:
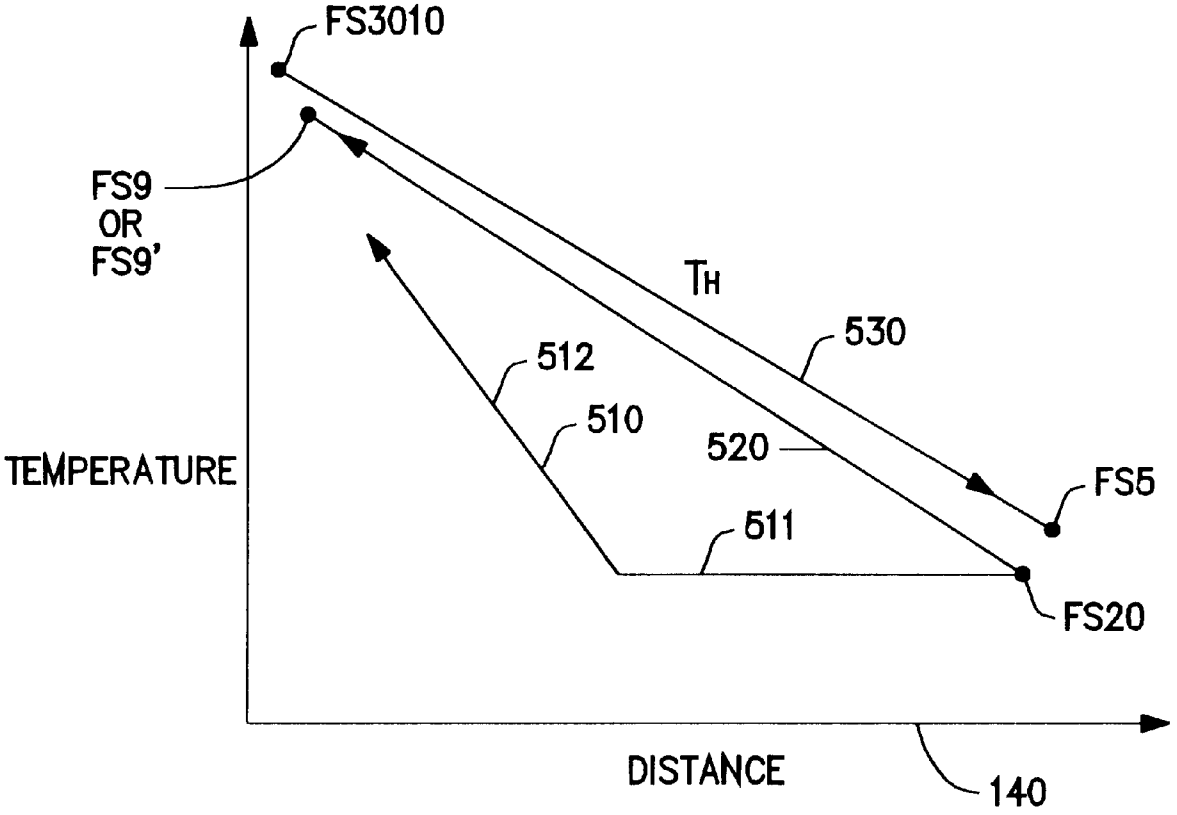
Figure 3 (PRIOR ART)
FIG. 3 is a graph illustrating the fundamental temperature vs. entropy relationships in a conventional Kalina cycle.
Figure 4:
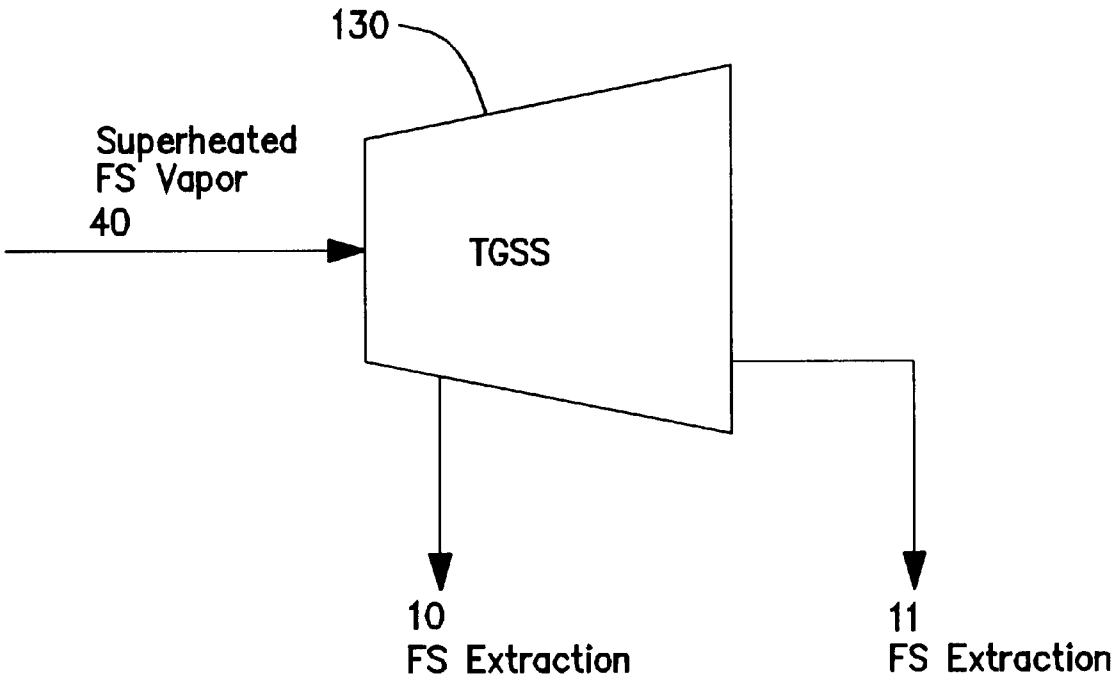
Figure 4 (PRIOR ART)
FIG. 4 is a diagram illustrating high pressure vapor, low pressure vapor, and condensate extraction for a HP turbine/generator in a conventional Kalina cycle system.
Figure 5:
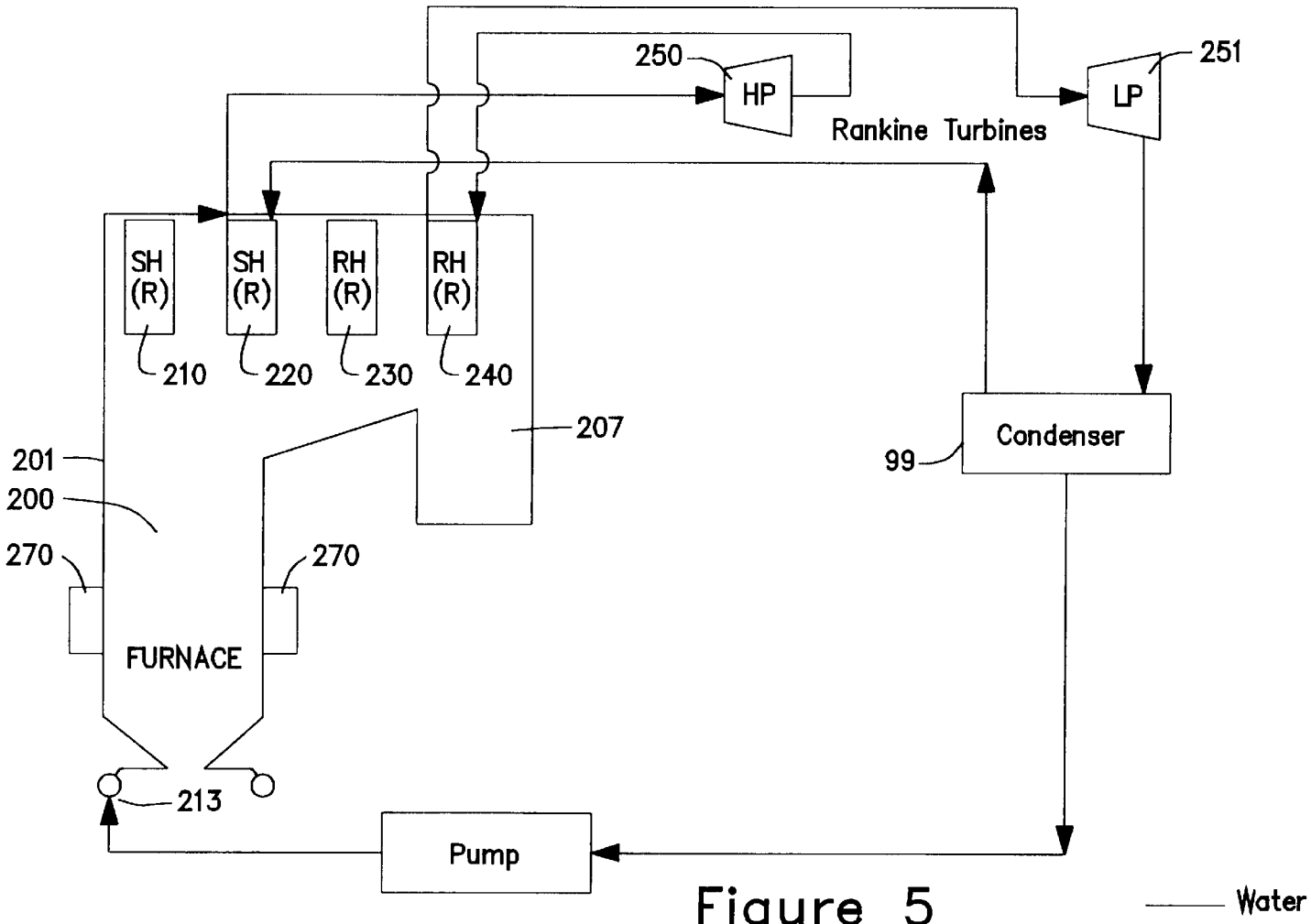
FIG. 5 is a diagram illustrating a conventional Rankine cycle power generation system.

FIG. 5 shows a Rankine cycle system including a furnace 200, a plurality of turbines, including a high pressure turbine (HP) 250 and a low pressure turbine (LP) 251, and a condenser 99.

Furnace 200 has a backpass 207 for collecting heat energy from combustion gases created by burners 270. The walls of furnace 200 include a plurality of tubes surrounded by firewall material which form a boiler 201. The burners 270 provide heat energy for the furnace 200.

Referring to FIG. 5, the Rankine cycle proceeds as follows. Water from feed pump 211 enters furnace 200 through water enter inlet, i.e., header, 213 of the furnace walls. A portion the water entering of the furnace walls 201 boils therein and is then evaporated in the tubes 201 to form a superheated vapor. The superheated vapor then enters superheater 220 to receive additional heat energy. The superheated vapor then flows to high pressure turbine 250 wherein heat is extracted from the superheated vapor to perform mechanical work. The expanded vapor from the output of the high pressure turbine 250 returns to the furnace to be reheated by reheater 240. The reheated vapor is then transported to low pressure turbine 251 wherein heat is extracted from the superheated vapor to perform mechanical work. From the pressure turbine 251 the expanded vapor then flows to condenser 99. Within condenser 99 the vapor from the turbine 251 is then cooled and converted back to water. This water is transported back to the feedwater drain 213 via pump 211, thus completing the Rankine cycle.

Figure 6:
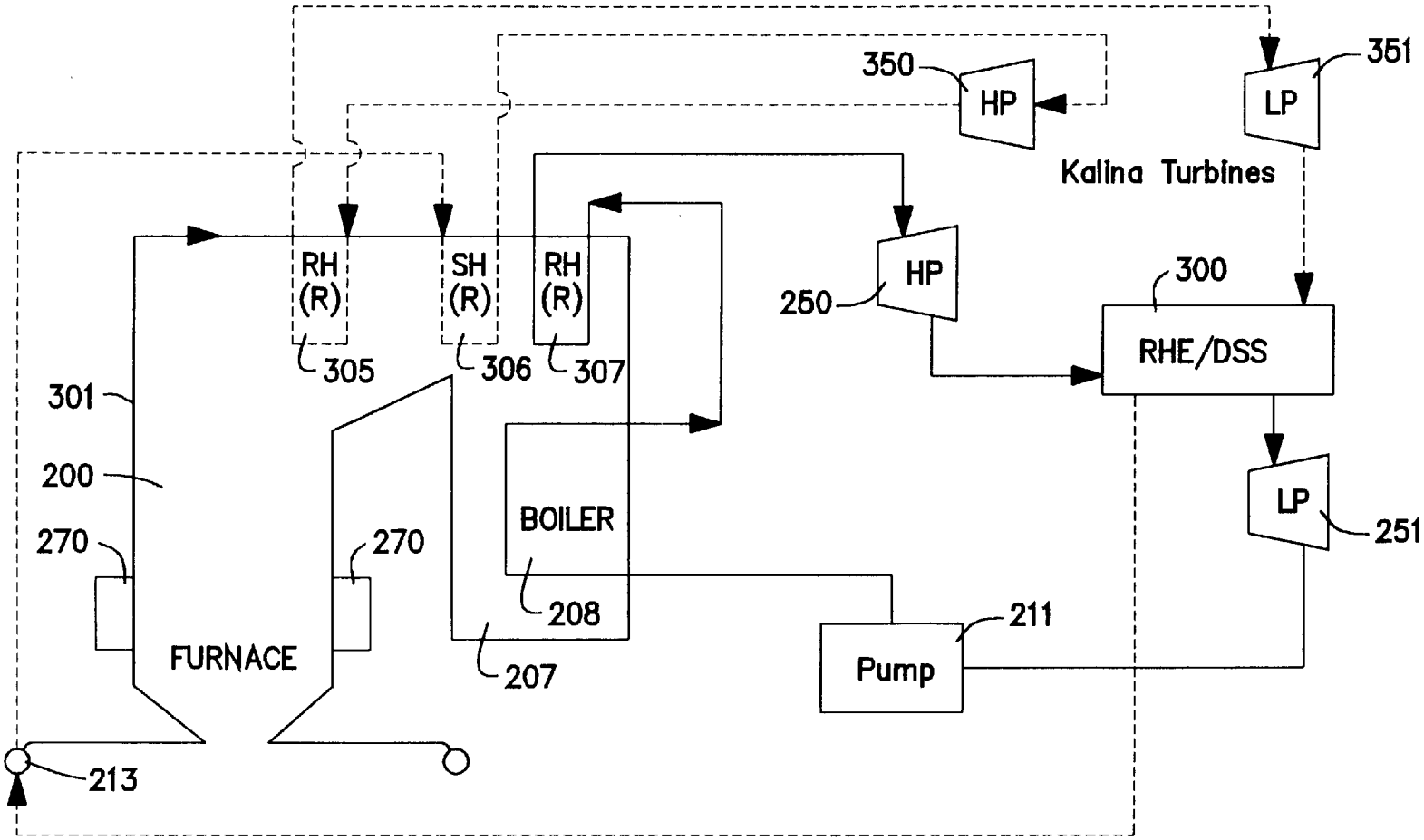
FIG. 6 is a diagram illustrating a hybrid power generation system including a Rankine cycle power generation system combined with a Kalina cycle power generation system.

FIG. 6 illustrates an embodiment of the present invention, a hybrid power generation system, including a conventional Rankine cycle subsystem, such as shown in FIG. 5, combined with a Kalina cycle subsystem. The co-pending application "Refurbishing Conventional Power Plants for Kalina Cycle Operations" describes a method for refurbishing a conventional Rankine cycle power generation system, such as shown in FIG. 5, to include a Kalina cycle subsystem. The Kalina cycle heaters capture excess heat that would otherwise be wasted in the conventional Rankine plant design. To reduce the cost of retrofitting and increase the plant efficiency, the furnace 200 remains in operation, with minor modifications.

Kalina cycle high pressure turbine 350 and low pressure turbine 351 are added to the Kalina cycle subsystem. Other embodiments of FIG. 6 are possible by varying components of the subsystems. For example, there may be one or more turbines, including intermediate pressure turbines, and one or more heaters and reheaters.

As shown in FIG. 6, in the present invention, the condenser 99 has been replaced by a distillation and condensation subsystem (DCSS) and a recuperative heat exchanger (RHE) 300. An embodiment of the present invention shown in FIG. 6 includes a Rankine cycle subsystem, designated by the solid lines, integrated with a Kalina cycle subsystem, designated by the dotted lines.

In an embodiment of the present invention, the Kalina cycle proceeds as follows. Binary working fluid from the RHE/DSS 300 enters furnace 200 through inlet, i.e., header, 213 of the furnace walls 301.

In the Kalina cycle subsystem, an ammonia/water fluid stream, i.e., a binary working fluid, may be heated by the recuperative generator(RHE)300 and sent to inlet 213.

The tubes of the furnace wall section 301 are configured to receive a binary working fluid for the Kalina cycle subsystem, and to direct the binary working fluid along a path to superheat the binary working fluid with heat from the heat source 270.

The section of furnace wall surrounding the tubes is exposed to the heat. The binary working fluid absorbs a portion of the heat from the furnace wall section which results in the furnace wall section being cooled. Subsequently, the binary working fluid having absorbed the heat of the furnace wall section is transformed into a superheated vapor.

The superheated vapor is then heated to a high temperature and sent from superheater 306 to the high pressure Kalina turbine 350. From the output of high pressure turbine 350 the vapor is then sent to reheater 305 wherein the vapor absorbs additional heat energy and then flows on to the low pressure turbine 351. The output from the low pressure turbine 351 is sent to the DCSS 300 wherein the output is then condensed back to a liquid. In addition, the heat energy in the exhaust from the low pressure turbine 351 may be used in the recuperative generator (RHE) 300 to vaporize the fluid stream. The binary working fluid is then sent to the inlet, i.e., header, 213. This completes the Kalina cycle.

The Rankine cycle is similar to that described in FIG. 5, with the modification that the Rankine cycle in the present invention shares the condenser located in the RHE/DCSS 300. In the Rankine cycle the working fluid from the RHE/DSS 300 moves to the low pressure turbine 251. From the low pressure turbine 251, the working fluid is pumped by pump 211 to the inlet of the boiler 308. From the boiler 308, the working fluid flows to superheater 307. The fluid then flows from the high pressure Rankine turbine 250 to the RHE/DSS. This completes the cycle.

The burners 270 of furnace 200 cause combustion gases to be generated along with heat. The furnace 200 has a backpass 207 wherein the flue gases are received. The flue gases from the backpass 207 ultimately flow to a smokestack (not shown) where the gases and residual heat energy is released to the environment. However, before the flue gases can flow to the smokestack, the gases must be cooled to a temperature, denoted as the smokestack temperature. The boiler 308 in the backpass absorbs heat from the flue gases of the backpass thereby increasing the temperature of the non-binary working fluid and concomitantly cooling the flue gases.

Figure 7:
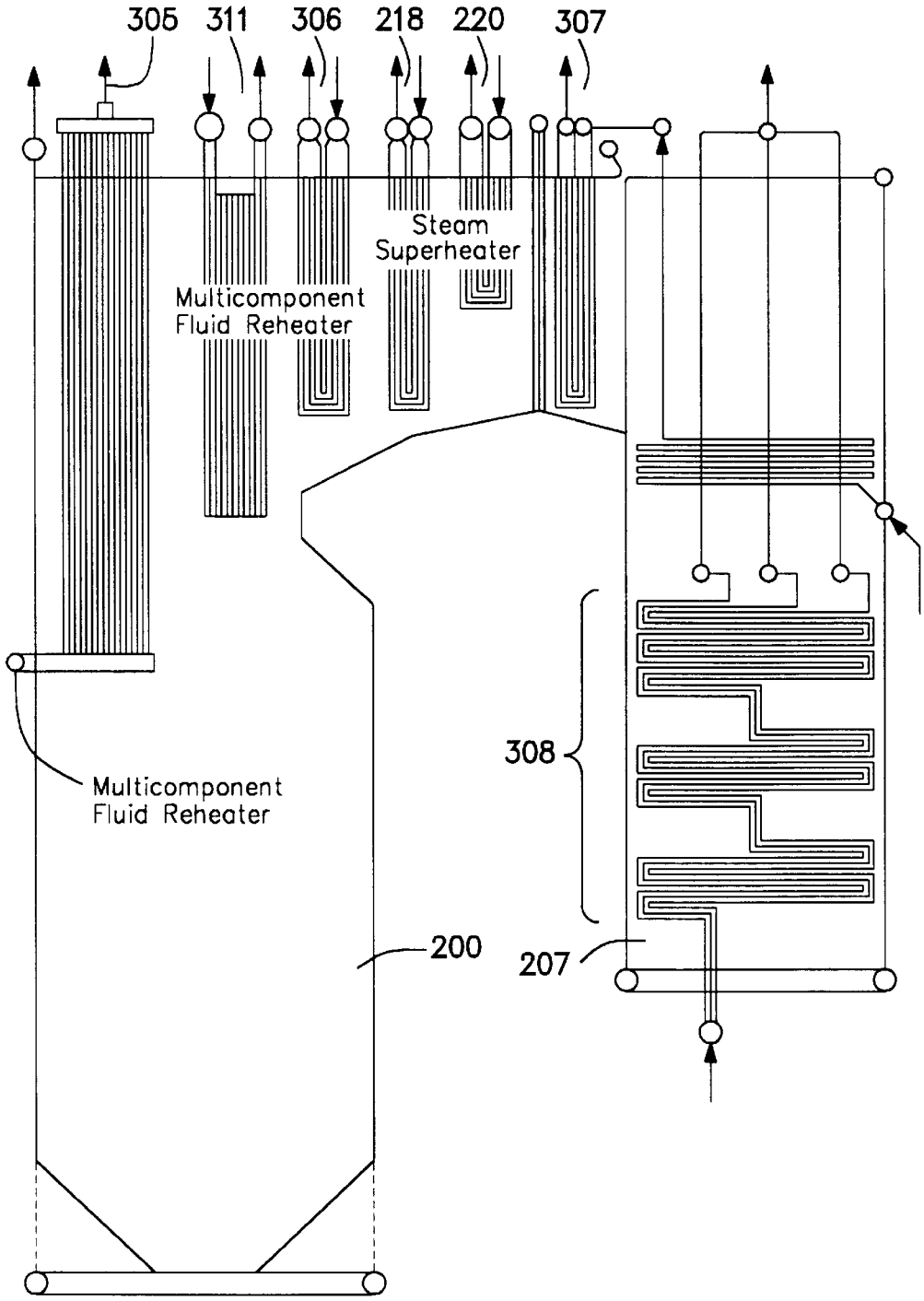
FIG. 7 is a diagram illustrating a vapor generation system combining a Rankine cycle with a Kalina cycle.

A drawing of the hybrid furnace 200 of the present invention of FIG. 6 is shown in FIG. 7. FIG. 7 shows multicomponent fluid reheater 305, multicomponent fluid reheater 311, multicomponent fluid superheater 306, steam superheater 210, steam superheater 220, steam superheater 307, and boiler 308 located in the backpass 207 of the furnace.

What is claimed is:

1. A vapor generator, comprising:

a first plurality of tubes configured to direct a multicomponent working fluid so as to be subjected to process heat and output to a first turbine; and a second plurality of tubes configured to direct a single component working fluid so as to be subjected to the process heat and output to a second turbine.

2. The vapor generator of claim 1, wherein:

the first plurality of tubes form a furnace wall with the multicomponent working fluid being supplied to the furnace wall in a vapor state.

3. The vapor generator of claim 2, wherein:

the multicomponent working fluid absorbs a portion of the process heat from the furnace wall thereby cooling the furnace wall.

4. The vapor generator of claim 2, wherein the furnace wall is located on a high temperature side of the furnace.

5. The vapor generator of claim 1, wherein the first plurality of tubes form a superheater.

6. The vapor generator of claim 1, wherein:

the process heat is heat from a direct fired source.

7. The vapor generator of claim 1, further comprising:

a furnace having a backpass receiving flue gases, wherein the first plurality of tubes are located in the furnace;

wherein the second plurality of tubes are located in the backpass and subjected to the process heat from the flue gases of the backpass so that the single component working fluid increases in temperature and the flue gases are cooled.

8. The vapor generator of claim 7, wherein:

the second plurality of tubes are configured to vaporize the single component working fluid.

9. The vapor generator of claim 7, wherein:

the second plurality of tubes are configured to superheat the single component working fluid.

10. The vapor generator of claim 7, wherein the first plurality of tubes form a superheater.

11. The vapor generator of claim 1, wherein the second plurality of tubes form a boiler.

12. The vapor generator of claim 1, wherein the multicomponent working fluid forms the working fluid of a non-Rankine cycle subsystem.

13. The vapor generator of claim 1, wherein the multicomponent working fluid forms the working fluid of a Kalina cycle subsystem.

14. The vapor generator of claim 1, wherein the single component working fluid forms the working fluid of a Rankine cycle subsystem.

15. A system for generating power, comprising;

a heat source producing heat; and a vapor generator, including;

a first plurality of tubes configured to direct a multicomponent working fluid so as to be subjected to the heat and output to a first turbine; and a second plurality of tubes configured to direct a single component working fluid so as to be subjected to the heat and output to a second turbine.

16. The system for generating power of claim 15, wherein:

the first plurality of tubes forming a furnace wall with the multicomponent working fluid being supplied to the furnace wall in a vapor state.

17. The system for generating power of claim 15, wherein the vapor generator further comprises:

a backpass receiving flue gases, wherein the second plurality of tubes are located in the backpass to absorb heat from the flue gases of the backpass so that the single component working fluid increases in temperature and the flue gases are cooled.

18. The system for generating power of claim 15, further comprising:

a non-Rankine cycle turbine, coupled to the vapor generator, receiving the multicomponent working fluid from the first plurality of tubes; and a Rankine cycle turbine, coupled to the vapor generator, receiving the single component working fluid from the second plurality of tubes.

19. The system for generating power of claim 18, wherein the non-Rankine cycle turbine receives the multicomponent working fluid from at least one superheater and the at least one superheater receives the multicomponent working fluid from the first plurality of tubes.

20. The system for generating power of claim 18, wherein the Rankine cycle turbine receives the single component working fluid from at least one superheater and the at least one superheater receives the single component working fluid from the second plurality of tubes.

21. A method of generating power, comprising the steps of:

moving a multicomponent working fluid through a first plurality of tubes so as to be subjected to process heat and directed to a first turbine; and moving a single component working fluid through a second plurality of tubes so as to be subjected to the process heat and directed to a second turbine.

22. The method of claim 21, wherein:

the first plurality of tubes form a furnace wall with the multicomponent working fluid being supplied to the furnace wall in a vapor state.

23. The method of claim 22, wherein:

the multicomponent working fluid absorbs a portion of the process heat from the furnace wall thereby cooling the furnace wall.

24. The method of claim 21, further comprising:

a backpass receiving flue gases, wherein the second plurality of tubes is located in the backpass and is subjected to the process heat by the flue gases of the backpass so that the single component working fluid increases in temperature and the flue gases are cooled.

25. The method of claim 21, further comprising the steps of:

moving the multicomponent working fluid through a non-Rankine cycle turbine to produce work; and moving the single component working fluid through a Rankine cycle turbine to produce work.

* * * * *